US010881172B1

(12) United States Patent
Straus

(10) Patent No.: US 10,881,172 B1
(45) Date of Patent: Jan. 5, 2021

(54) JEWELRY LINK ASSEMBLY AND A METHOD OF ASSEMBLING JEWELRY CHAIN LINKS

(71) Applicant: Perry Straus, Brooklyn, NY (US)

(72) Inventor: Perry Straus, Brooklyn, NY (US)

( * ) Notice: Subject to any disclaimer, the term of this patent is extended or adjusted under 35 U.S.C. 154(b) by 0 days.

(21) Appl. No.: 16/867,522

(22) Filed: May 5, 2020

(51) Int. Cl.

| | |
|---|---|
| ***A44C 11/00*** | (2006.01) |
| ***A44C 27/00*** | (2006.01) |
| ***A44C 5/10*** | (2006.01) |
| ***B21L 11/00*** | (2006.01) |
| ***B21L 13/00*** | (2006.01) |
| ***A44C 13/00*** | (2006.01) |

(52) U.S. Cl.
CPC ..... *A44C 11/00* (2013.01); *A44C 5/102* (2013.01); *A44C 13/00* (2013.01); *A44C 27/00* (2013.01); *B21L 11/005* (2013.01); *B21L 13/00* (2013.01)

(58) Field of Classification Search
CPC ..... A44C 11/00; A44C 5/102; A44C 13/00; A44C 27/00; A44C 5/107; A44C 11/02; B21L 11/005; B21L 13/00
See application file for complete search history.

(56) References Cited

U.S. PATENT DOCUMENTS

| | | | | | |
|---|---|---|---|---|---|
| 3,066,501 | A * | 12/1962 | Charles | A44C 11/002 | 63/39 |
| 3,192,738 | A * | 7/1965 | Charles | A44C 11/002 | 63/39 |
| 3,323,325 | A * | 6/1967 | Meyer | A44C 11/002 | 63/4 |
| 3,357,204 | A * | 12/1967 | Davis | A44C 11/002 | 63/39 |
| 4,044,725 | A * | 8/1977 | Miller | A01K 27/001 | 119/865 |
| 4,397,145 | A * | 8/1983 | Reist | F16G 13/10 | 59/78 |
| 5,301,498 | A | 4/1994 | Chia et al. | | |
| 5,341,634 | A | 8/1994 | Straight | | |
| 6,786,032 | B2 | 9/2004 | Chia et al. | | |
| 8,607,541 | B1 * | 12/2013 | Cavuoti | A63H 33/062 | 59/2 |
| 2019/0274397 | A1 * | 9/2019 | Jakob | A44C 5/0023 | |

FOREIGN PATENT DOCUMENTS

| | | | | |
|---|---|---|---|---|
| CH | 696956 A5 * | 2/2008 | | A44C 5/102 |
| DE | 29711631 U1 * | 9/1997 | | A44C 11/00 |
| DE | 102009042237 A1 | 3/2011 | | |
| WO | WO-9722275 A1 * | 6/1997 | | A44C 11/00 |

* cited by examiner

*Primary Examiner* — Jack W Lavinder
(74) *Attorney, Agent, or Firm* — Hulsey P.C.

(57) ABSTRACT

A jewelry link assembly and a method of assembling jewelry chain links are disclosed. The jewelry link assembly comprises a male member comprising a ball portion having two prongs at opposite ends. The jewelry link assembly comprises a female member having two wings. Each wing comprises a prong receiving section. The ball portion is received between the two wings such that the prongs are made to slide into the prong receiving sections provided at the two wings for interlocking the male and female members. The jewelry link assembly further comprises chain links connected at far ends of the male and female members for forming a two-piece design configuration of the chain links together with the male and female members. The chain links, and the male and female members, are connected alternatively and successively to form a jewelry link assembly.

18 Claims, 6 Drawing Sheets

JEWELRY LINK ASSEMBLY AND A METHOD OF ASSEMBLING JEWELRY CHAIN LINKS

FIELD OF THE DISCLOSURE

The present disclosure relates to links for use in jewelry or other decorative articles. More particularly, the present disclosure relates to a jewelry link assembly comprising a unique ball and socket joint mechanism used with a standard chain link.

BACKGROUND OF THE DISCLOSURE

It is known that jewelry chains and/or decorative articles are generally used as a decorative element in a variety of manners. The jewelry chains may be used as garment belting or worn by individuals in the form of necklaces and bracelets. Typically, the jewelry chains consist of a series of links often manufactured by hand and require patience, dexterity, and an artistic flair. It is known that the links are formed of regular polygonal or round structures or other structures, and such links when individually formed, usually are formed with gaps to permit intertwining of the links to form the jewelry chain.

Several examples of jewelry chains comprising links have been disclosed in the past. One such example is disclosed in a U.S. Pat. No. 5,301,498, entitled "Rope chain component." U.S. Pat. No. 5,301,498 discloses that the invention is a unitary component that may be substituted intermittently for portions of a jewelry rope chain. The unitary component has connecting means that promotes the integration of the component with the conventional rope chain by receiving onto the component the individual links of the rope chain in their ordinary sequence and position as those links are sequentially and positionally comprised on a conventional rope chain. The use of the component with conventional rope chain segments results in savings of precious metal and labor costs while retaining many of the flexibility and aesthetic advantages of the conventional rope chain. The preferred embodiment of the rope chain is spiral in shape but may take on various other configurations.

Another example is disclosed in a U.S. Pat. No. 6,786,032, entitled "Jewelry closed-link element, assembled chain, and method of manufacture." U.S. Pat. No. 6,786,032 discloses that a closed-link element and a chain made from such link elements are manufacturing by a process, wherein each link element exhibits a unique visual property, such as coloration, surface texture, reflectivity, design feature or characteristic, shape, or other visually attractive appearance. Methods of construction include surface pre-texturing, stamping, simultaneous surface texturing and stamping, and wire bending. Such unique visual property traits for the succession of link elements results in a more attractive, fanciful, more delicate and interesting fashion item. Each of the interconnected link elements may have the same or different visual properties, and may have multiple portions of varying color, texture, or other visual properties. In other aspects of the invention, each link element may have differently shaped portions. Additionally, the interior and/or exterior edges of the link element may exhibit different shapes, colors, patterns, or textures.

Another example is disclosed in a U.S. Pat. No. 5,341,634, entitled "Interlocking link chain." U.S. Pat. No. 5,341,634 discloses that an interlocking link chain for use in jewelry and other decorative items. The interlocking links can be assembled and disassembled by the wearer without special tools and without an unusual degree of dexterity. The wearer can assemble a chain of any length for use as a bracelet, a necklace, a belt, or other decorative items. Each link has a tab portion and a slot portion. Each link may also have a body portion, which expresses an artistic or decorative motif. In some embodiments, the tab and the slot may be made an integral part of the decorative motif. The links are arranged in a linear chain so that the tab portion of each link interlocks with the slot portion of the adjacent link. The links are made in a generally planar configuration that lends itself to low cost manufacturing methods, such as sheet metal forming techniques or injection molding.

Yet another example of a jewelry chain is disclosed in a German Patent Application no: 102009042237A1, entitled "Chain system has two chain links, which are provided with head and lower face, where head is attached in lower face of adjacent chain link in force-fit manner." DE102009042237A1 discloses that the invention has for its object to develop a chain system, which allows without tools use a lengthening or shortening while ensuring a positive and freely rotatable connection. In the case of the chain of the type described, the object is achieved in that the chain system is based on a connector that allows engagement of a chain link head in a chain link belly. The connector is achieved in that either the limb or the member head are slotted so that they can easily squeeze or widen. Only with little effort and without tools is such a chain connector to expand or shorten other links. As a jewelry chain, the plug-in system offers numerous design advantages. The simple assembly of the chain links allows any extension and shortening of a jewelry chain. The possibility of connecting chain links made of different materials offers almost unlimited design possibilities.

Although the jewelry chains comprising links of known art are simple to assemble that a wearer could assemble their own chain of the desired length, they have few problems. For instance, the links have long been attached to each other by soldering. Soldering is a labor-intensive task and thus is expensive, time consuming and requires detailed attention. Further, every single link in the jewelry chain is soldered. As a result, it restricts free and flowing movement of the individual links.

Therefore, there is a need for improvement in the structure/functions, use and manufacture of links for use in jewelry or other decorative articles. The present disclosure makes possible a number of the needed solutions to current state of the art.

BRIEF SUMMARY OF THE DISCLOSURE

It is an object of the present invention to provide a jewelry link assembly comprised of a unique ball and socket joint within a standard chain-link that avoids the drawback of known links.

It is another object of the present invention to provide an improved jewelry link assembly comprising links with minimum soldering.

It is another object of the present invention to reduce costs of assembling jewelry links to form jewelry chains, bracelets, necklaces and the like.

It is yet another object of the present invention to join links for any type of jewelry, including but not limited to bracelets, pendants, earrings and necklaces.

It is yet another object of the present invention to provide unique links for use in a chain or bracelet so as to enhance the flexible movement between the links.

It is yet another object of the present invention to provide a jewelry link assembly for a chain, or a bracelet or other jewelry in which links can easily be added or removed so as to adjust the size/length of the jewelry chain without the need for extensive soldering at every link.

In order to achieve one or more of the objects, the present invention provides a jewelry link assembly comprising a unique ball and socket joint within standard chain links. The jewelry chain comprises a male member, a female member and standard links. In the present invention, the male member acts a ball, and the female member acts as a socket, respectively in the ball-socket joint mechanism. The male member comprises a ball portion having prongs extending through center axis of the ball portion. The male member further comprises a loop at one end for receiving a standard chain link.

The female member comprises two wings, each wing having a cut section or prong receiving section for receiving prongs of the male member. One of the wings is casted as a fixed part and other wing is casted as operable wing in a semi-opened formation that can be squeezed for locking the ball portion between the wings. Further, the female member comprises a loop at one end for receiving another standard chain link.

In order to form the ball-socket joint with the male and female members, the ball portion of the male member is placed inside the wings such that one prong is made to slide into the prong receiving section of the fixed wing.

Subsequently, the operable wing/semi-opened wing is squeezed into a closed position such that as the operable wing is clamped down around the ball portion, the prong slides into the prong receiving section of the operable wing thereby interlocking the male and female members. Further, the standard chain links are drawn through the loops provided at respective ends of the male and female members. Here, only the standard chain links are soldered thus requiring every two links i.e., the standard chain links to be soldered, instead of soldering every single link. The ball and socket joint formed with the help of the male and female members when combined with standard chain links form a two-piece design configuration and interlocking system.

In one advantageous feature of the present invention, the jewelry link assembly comprising the unique ball and socket joint within standard chain links gives flexibility and mechanical function (hinging) when compared to other links. The ability of the unique ball and socket joint to connect chain links without soldering makes it more sustainable and efficient to assemble when compared to traditional chain-making links. Further, the unique ball and socket joint ensures that every two links is soldered, versus the need to solder every single link.

Other objects, technical aspects and advantages of the presently disclosed jewelry link assembly will become apparent upon reading the technical description appearing below.

BRIEF DESCRIPTION OF THE DRAWINGS

The present subject matter will now be described in detail with reference to the drawings, which are provided as illustrative examples of the subject matter so as to enable those skilled in the art to practice the subject matter. Notably, the FIGUREs and examples are not meant to limit the scope of the present subject matter to a single embodiment, but other embodiments are possible by way of interchange of some or all of the described or illustrated elements and, further, wherein.

It will be noted that throughout the appended drawings, like features are identified by like reference numerals.

DETAILED DESCRIPTION OF ILLUSTRATIVE EMBODIMENTS

The detailed description set forth below in connection with the appended drawings is intended as a description of exemplary embodiments in which the presently disclosed subject matter can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed subject matter may be practiced without these specific details. In some instances, well-known structures and devices are shown in functional or conceptual diagram form in order to avoid obscuring the concepts of the presently disclosed jewelry link assembly.

In the present specification, an embodiment showing a singular component should not be considered limiting. Rather, the subject matter preferably encompasses other embodiments including a plurality of the same component, and vice-versa, unless explicitly stated otherwise herein. Moreover, the applicant does not intend for any term in the specification or claims to be ascribed an uncommon or special meaning unless explicitly set forth as such. Further, the present subject matter encompasses present and future known equivalents to the known components referred to herein by way of illustration.

Although the present disclosure provides a description of a jewelry link assembly, it should be understood that the description is by way of example only and is not to be construed in a limiting sense. It is to be further understood that numerous changes may arise in the details of the embodiments of this jewelry link assembly. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Figure 1:
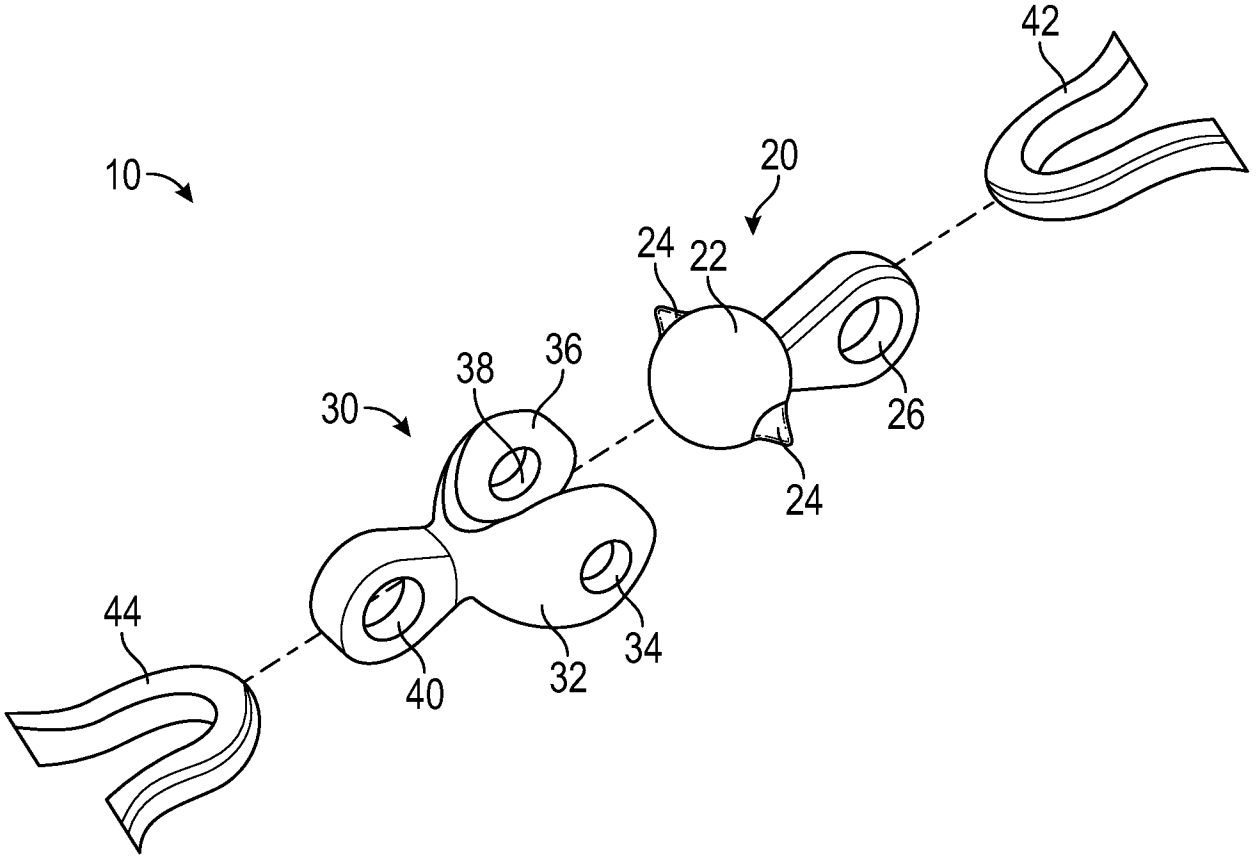
FIG. 1 illustrates an exploded perspective view of a jewelry link assembly comprising a male member, a female member and chain links in accordance with one embodiment of the present disclosure.

For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

It should be understood that the present invention describesa jewelry link assembly and a method of assembling jewelry chain links. The jewelry link assembly comprises a male member comprising a ball portion having two prongs at opposite ends. The jewelry link assembly comprises a female member having two wings. Each wing comprises a prong receiving section. The ball portion is received between the two wings such that the prongs are made to slide into the prong receiving sections for interlocking the male and female members. The jewelry link assembly further comprises chain links connected at far ends of the male and female members for forming a two-piece design configuration. The chain links, and the male and female members, are connected alternatively and successively to form a jewelry link assembly.

Various features and embodiments of a jewelry link assembly are explained in conjunction with the description of FIGS. 1-6B.

Figure 2A:
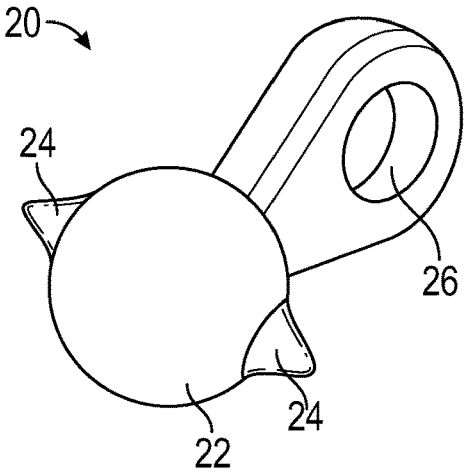
FIGS. 2A, 2B and 2C illustrate a perspective, a front perspective and a side view, respectively of the male member.
Figure 2B:
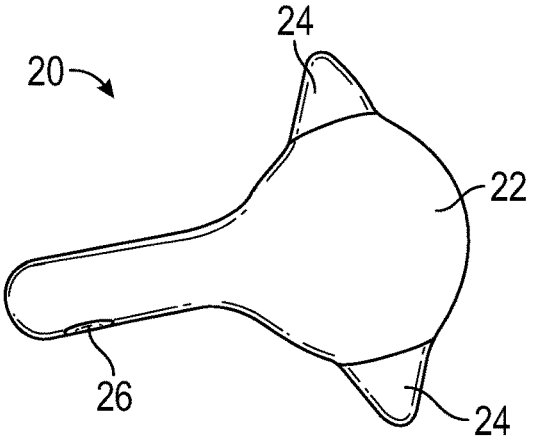
Figure 2C:
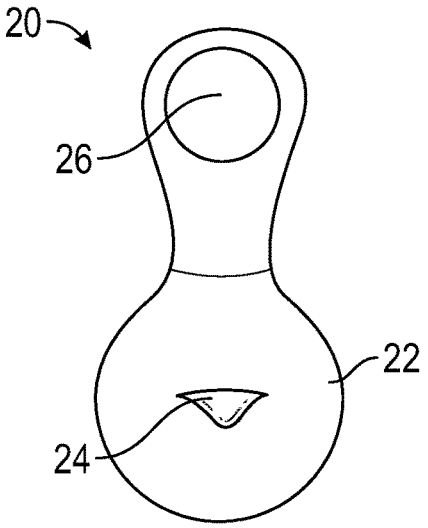

Referring to FIG. 1, an exploded perspective view of a jewelry link assembly 10 is shown, in accordance with one embodiment of the present invention. The jewelry link assembly 10 comprises a male member 20, a female member 30 and chain links i.e., a first chain link 42 and a second chain link 44. Now Referring to FIGS. 2A, 2B and 2C, constructional features of the male member 20 is explained. It should be understood that FIGS. 2A, 2B and 2C show a perspective, a front perspective and a side view, respectively of the male member 20. The male member 20 might be made up of metal, plastic, glass, or any other standard jewelry material. As can be seen from FIGS. 2A, 2B and 2C, the male member 20 comprises a ball portion or rounded portion 22. Further, the male member 20 comprises prongs 24 extending from the rounded portion 22 at both sides of the male member 20. It should be understood that the prongs 24 are configured to extend through a center axis of the ball portion 22. In one example, the prongs 24 might be provided in a relatively triangular shape. In another example, the prongs 24 might be provided in square or rectangular or any other shape. Further, the male member 20 comprises a first loop 26 provided at one end of the ball portion 22. Specifically, the first loop 26 might be provided at one end of the ball portion 22 perpendicular to the prongs 24.

As specified above, the jewelry link assembly 10 comprises the female member 30. Now referring to FIGS. 3A and 3B, a perspective view of the female member 30 in closed position and a side view of the female member 30 in semi-open position, respectively are shown, in accordance with one embodiment of the present invention. It should be understood that the female member 30 might be made up of metal, plastic, glass, or any other standard jewelry material. As can be seen, the female member 30 comprises two wings i.e., a first wing 32 and a second wing 36 extending outwardly from one another. It should be understood that the first wing 32 and the second wing 36 form a U-shape or cup section when in closed position (as shown in at least FIGS. 3A, 4C and 5). As can be seen in at least FIG. 3A, the first wing 32 comprises a first prong receiving section or first opening or first cut section 34 configured to receive one of the prongs 24 of the male member 20. Further, the second wing 36 comprises a second prong receiving section or second opening or second cut section 38 configured to receive one of the prongs 24 of the male member 20. In one embodiment, each of the first prong receiving section 34 and the second prong receiving section 38 might be provided in a triangular shape. In another embodiment, each of the first prong receiving section 34 and the second prong receiving section 38 might be provided in a square, rectangular or any other shape. It should be understood that the shape and size of the first prong receiving section 34 and the second prong receiving section 38 are dependent on the shape and size of the prongs 24 provided at the ball portion 22 of the male member 20. The shape and size of the first prong receiving section 34 and the second prong receiving section 38 are provided slightly larger than the shape of the prongs 24 so as to receive the prongs 24 in them.

Figure 3B:
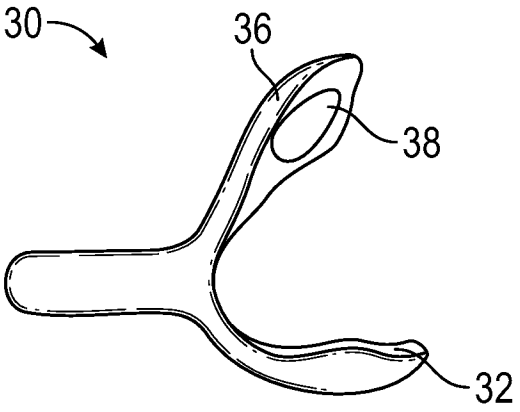
FIGS. 3A and 3B illustrate a perspective view in closed position and a side view in semi-open position of the female member.
Figure 3A:
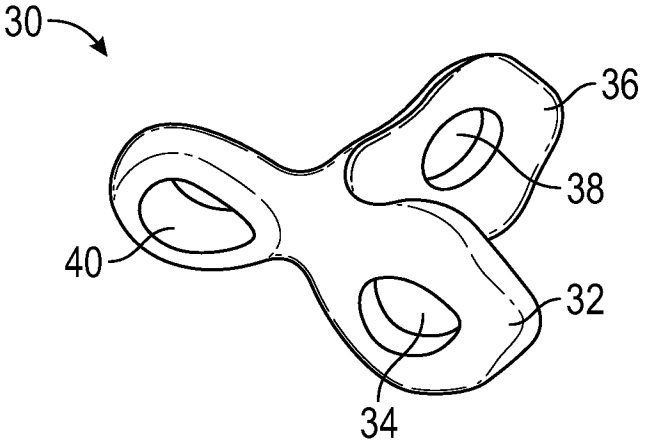

Further, the female member 30 comprises a second loop 40 provided at one end of the ball portion 22, as can be seen from FIG. 3A. Specifically, the first loop 26 might be provided at one end of the ball portion 22 perpendicular to the prongs 24.

Further, the jewelry link assembly 10 comprises the chain links i.e., the first chain link 42 and the second chain link 44, as shown in FIG. 1. Each of the first chain link 42 and the second chain link 44 might be provided in a horseshoe shape or U-shape configuration. Each of the first chain link 42 and the second chain link 44 might be made up of metal, plastic or any other jewelry material.

Now referring to FIG. 3B through 5, mounting of the male member 20 to the female member 30, and mounting of the chain link, for example the first chain link 42 to the male member 20 is explained. In accordance with the present embodiment, the first wing 32 and the second wing 36 are cast in a semi-open position (cup shape or U-shape), as shown in FIG. 3B. Specifically, the first wing 32 is casted as a fixed part and the second wing 36 is casted as a half (½) open or semi-open part ready to receive the prong 24. In other words, the first wing 32 acts as a fixed wing and the second wing 36 acts as an operable wing that is configured to operate between a semi-open position (FIG. 3B) to a closed position (FIG. 3A or FIG. 4C).

Figure 4B:
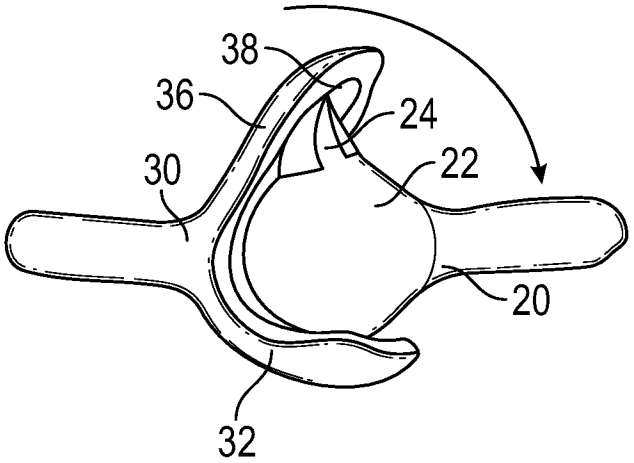
FIGS. 4A through 4C illustrate a feature of mounting the male member to the female member.
Figure 4A:
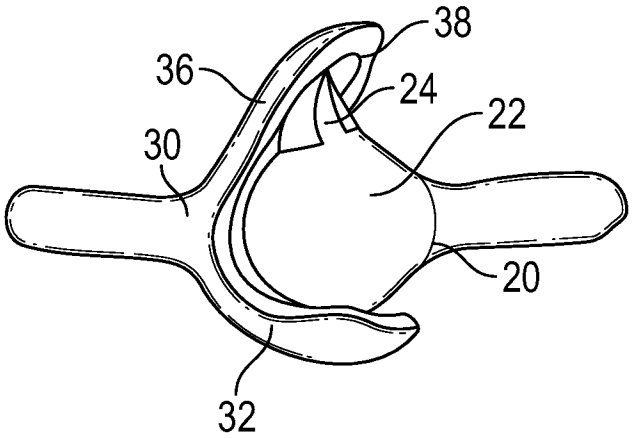
Figure 4C:
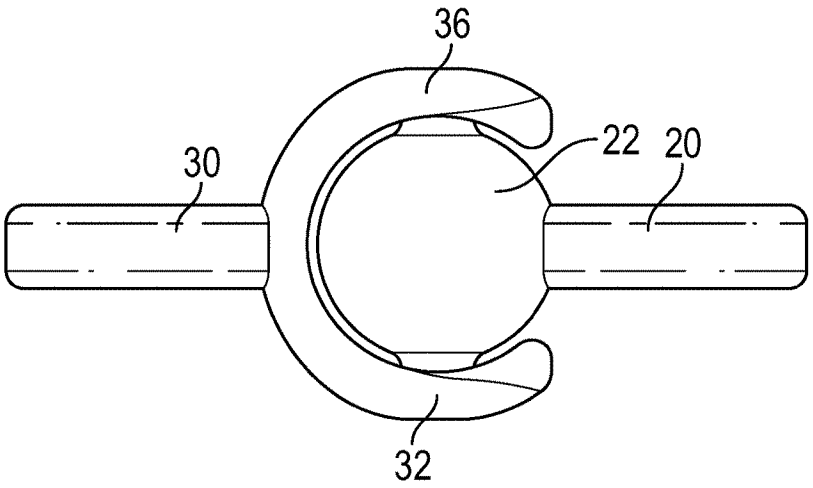

In order to mount the male member 20 to the female member 30, at first, the second wing 36 is raised or opened (semi-open position) as shown in FIG. 3B. Further, the male member 20 is received in the female member 30. Specifically, the ball portion 22 of the male member 20 is placed inside the first wing 32 and the second wing 36, and one of the prongs 24 is made to slide into the first prong receiving section 34 of the first wing 32, as shown in FIG. 4A. Further, the second wing 36 is squeezed from the semi-open position into the closed position, as shown in FIG. 4B. As the second wing 36 is clamped/squeezed down around the ball portion 22 of the male member 20, the prong 24 on other end slides into the second prong receiving section 38 of the second wing 36 thereby interlocking the male member 20 and the female member 30, as shown in FIG. 4C. When the male member 20 is mounted to the female member 30, they form a link similar to a ball and socket joint, where the male member 20 acts a ball and the female member 30 acts a socket.

Figure 5:
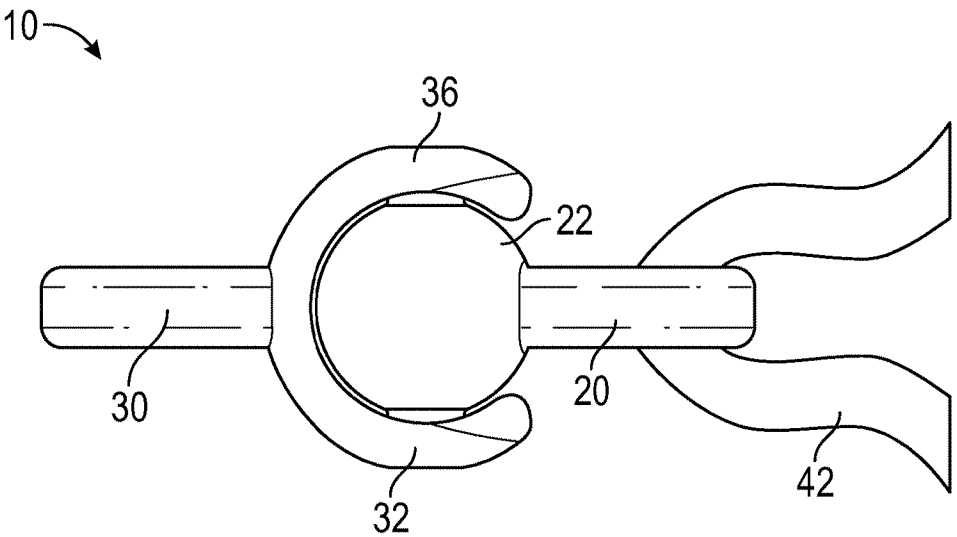
FIG. 5 illustrates a feature of mounting a first chain link to the male member.

After mounting the male member 20 to the female member 30, a first chain link 42 and a second chain link 44 might be used to form a complete/combined links in the jewelry link assembly 10. In order to mount the first chain link 42 and the second chain link 44 to the male member 20 to the female member 30, at first, the first chain link 42 might be drawn though the first loop 26 of the male member 20, as shown in FIG. 5. Similarly, the second chain link 44 might be drawn though the second loop 40 of the female member 30.

In order to form the jewelry link assembly 10 of suitable length plurality of male members 20, the female members 30 and the chain links 42, 44 might be used. Now referring to FIGS. 6A and 6B, a perspective and top view of the jewelry link assembly 10 is shown, in accordance with one embodiment of the present invention. As specified above, the male member 20 is mounted to the female member 30 and the first chain link 42 is drawn though the first loop 26 of the male member 20 and the second chain link 44 might be drawn though the second loop 40 of the female member 30. In order to form the jewelry link assembly 10 of the suitable length, the second chain link 44 might be mounted to the first chain link 42 that in turn is mounted to another male member 20. At the other end, the first chain link 42 is mounted to the second chain link 44 that in turn is mounted to another female member 20. In other words, the jewelry link assembly 10 is formed by connecting the chain links 42; 44 and the male and female members 20; 30 alternatively and successively until a suitable length is achieved.

In accordance with one embodiment, the first chain link 42 and the second chain link 44 are soldered, and the male member 20 and the female member 30 are interlocked with their unique features. As such, the male member 20 and the female member 30 form a flexible/bendable connection and the chain links 42, 44 soldered together forms a rigid structure. This way, a series of male member 20 and the female member 30 combined alternatively and successively with the chain links 42, 44 can be added to form the jewelry link assembly 10 of suitable length.

In order to adjust the length of the jewelry link assembly 10, the second wing 36 is operated (as shown in FIG. 4A) allowing the male member 20 to be removed and to permit successive links (the male member 20 and the female member 30) to either be added or removed to the chain links 42; 44.

Figure 6A:
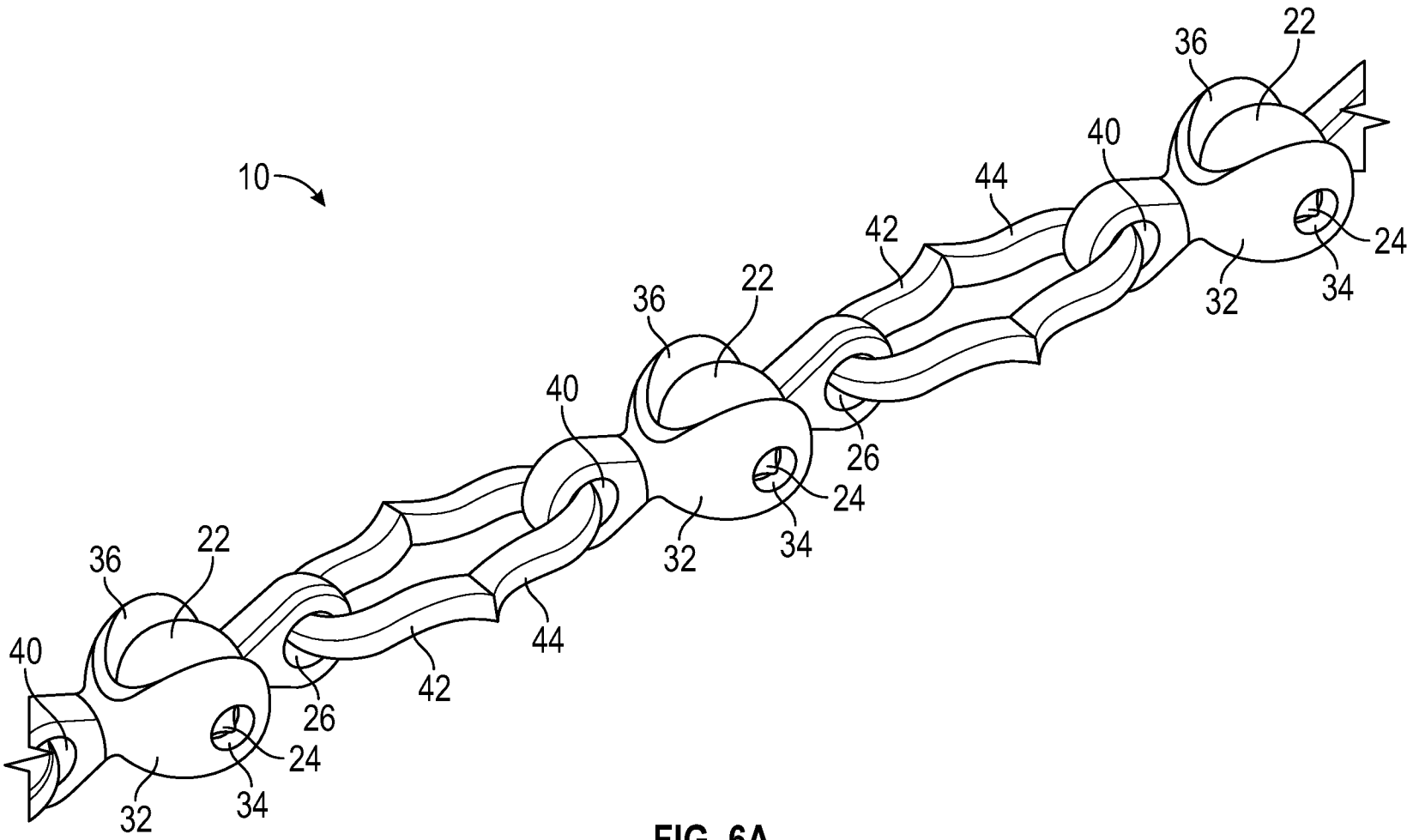
FIGS. 6A and 6B illustrate a perspective and top view, respectively of the jewelry link assembly.
Figure 6B:
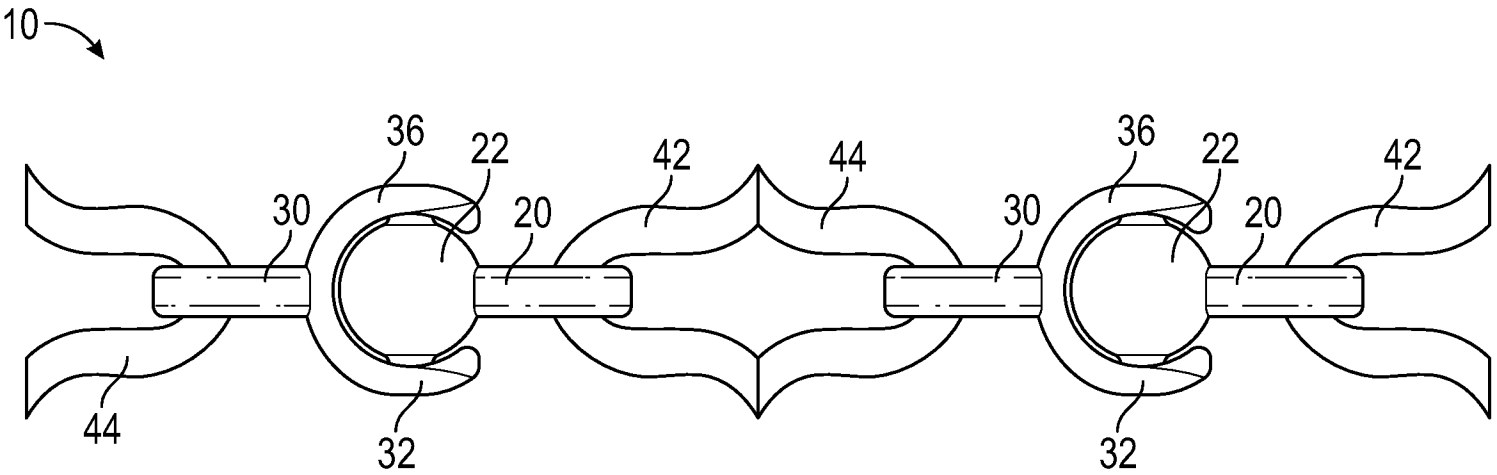

When a plurality of links (male and female members, and the chain links) is assembled as shown in FIG. 6A, the chain links 42; 44 connected by soldering may form a rigid connection and limit the freedom of rotation and/or movement between the chain links 42; 44. However, due to the ball portion 22 and the prongs 24, the male member 20 may allow freedom of rotation and movement between respective interconnected links (i.e., the ball portion 22 and the wings 32; 36). In other words, the male member 20 and the female member 30 will be able to pivotally move one with respect to the other without the use of solder.

In accordance with the current embodiment, the male member 20 and the female member 30 are connected by locking the prongs 24 in the prong receiving sections 34, 38 of the female member 30, and the chain links 42, 44 are connected by soldering. As such, soldering is performed for every two links (chain links 42; 44). When compared to known art where links are soldered for every single link, the present invention requires soldering every two links i.e., where the chain links 42; 44 meet. A person skilled in the art will appreciate that the reduction in soldering to every two links can be attributed to the unique two-piece design configuration of the chain links 42; 44 together with the male member 20 and the female member 30, and interlocking system of the male member 20 and the female member 30, as explained above.

In addition, the unique constructional features of the male member 20 and the female member 30 allow them to connect in a ball and socket joint mechanism along with the standard chain links 42, 44. As a result, the combination of the ball and socket joint mechanism of the male member 20 and the female member 30, and the chain links 42; 44, give the jewelry link assembly 10 a flexibility and mechanical function (i.e., hinging capability at the male member 20 and the female member 30). Further, the jewelry link assembly 10 comprising the combination of the male member 20 and the female member 30, and the chain links 42; 44 provide a more sustainable and efficient way to assemble when compared to the known links.

Although the description is explained with respect to a single row of links comprising combination of chain links and interlocking of the male and female member, a person skilled in the art will appreciate that multiple rows of links may also be assembled/combined/produced and can be included within the concept of the invention.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure.

In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein, but is to be accorded the widest scope consistent with the principles and novel features disclosed herein. It is contemplated that additional embodiments are within the spirit and true scope of the disclosed subject matter.

What is claimed is:

1. A jewelry link assembly, comprising:

a male member comprising a first closed loop at one end and a ball portion at other end, the ball portion having two prongs at opposite ends;

a female member comprising two wings at one end and a second closed loop at other end, wherein each wing having a prong receiving section, wherein the ball portion is received between the two wings such that the prongs are made to slide into the prong receiving sections for interlocking the male and female members; and chain links connecting the male and female members for forming a two-piece design configuration of the chain links together with the male and female members, wherein the chain links connect the first closed loop of the male member and the second closed loop of the female member, wherein the chain links, and the male and female members, are connected alternatively and successively to form a jewelry link assembly.

2. The jewelry link assembly of claim 1, wherein one wing of the two wings is fixed and another wing is operable in that the operable wing is operated between a semi-open position and a closed position.

3. The jewelry link assembly of claim 2, wherein the ball portion is received between the two wings such that a prong of the two prongs is made to slide into the prong receiving section at the fixed wing, and the operable wing is clamped down from the semi-open position to the closed position for sliding another prong at opposite end of the ball portion into the prong receiving section at the operable wing for interlocking the male and female members.

4. The jewelry link assembly of claim 1, wherein each of the two prongs extends from a center axis of the ball portion.

5. The jewelry link assembly of claim 1, wherein the first closed loop is substantially perpendicular to each of the two prongs provided at the ball portion.

6. The jewelry link assembly of claim 1, wherein the second closed loop is substantially perpendicular to each of the two wings of the female member.

7. The jewelry link assembly of claim 1, wherein the male member and the female member are connected similar to a ball and socket joint, wherein the male member indicates the ball and the female member indicates the socket of the ball and socket joint.

8. The jewelry link assembly of claim 1, wherein the chain links are provided in a U-shape or horseshoe configuration.

9. The jewelry link assembly of claim 1, wherein the chain links are connected using soldering.

10. A jewelry link assembly, comprising:

a male member comprising a ball portion having two prongs at opposite ends, wherein the male member comprises a first closed loop at one end;

a female member comprising two wings, wherein one wing of the two wings is fixed and another wing is operable in that the operable wing is operated between a semi-open position and a closed position, wherein each of the two wings comprises a prong receiving section, wherein the female member comprises a second closed loop at one end, and wherein the ball portion is received between the two wings such that a prong of the two prongs is made to slide into the prong receiving section at the fixed wing, and the operable wing is clamped down from the semi-open position to the closed position for sliding the another prong at opposite end of the ball portion into the prong receiving section at the operable wing for interlocking the male and female members; and chain links, each chain link drawn through the first closed loop and the second closed loop, respectively for forming a two-piece design configuration of the chain links together with the male and female members, and wherein the chain links, and the male and female members, are connected alternatively and successively to form a jewelry link assembly.

11. The jewelry link assembly of claim 10, wherein each of the two prongs extends from a center axis of the ball portion.

12. The jewelry link assembly of claim 11, wherein the first closed loop is substantially perpendicular to each of the two prongs.

13. The jewelry link assembly of claim 10, wherein the second closed loop is substantially perpendicular to each of the two wings of the female member.

14. The jewelry link assembly of claim 10, wherein the male member and the female member are connected similar to a ball and socket joint, wherein the male member indicates the ball and the female member indicates the socket of the ball and socket joint.

15. The jewelry link assembly of claim 10, wherein the chain links are provided in a U-shape or horseshoe configuration.

16. The jewelry link assembly of claim 10, wherein the chain links are connected using soldering.

17. A method to assemble jewelry chain links, the method comprising:

forming a male member having a first closed loop at one end and a ball portion at other end, the ball portion having prongs at opposite ends;

forming a female member comprising a second closed loop at one end, and a fixed wing and an operable wing at other end, each of the fixed wing and the operable wing are formed to include a prong receiving section;

slipping the ball portion into the female member by sliding the prongs into the prong receiving section at the fixed wing and the operable wing; and connecting chain links to the male and female members for forming a two-piece design configuration of the chain links together with the male and female members, wherein the chain links connect the first closed loop of the male member and the second closed loop of the female member, wherein the chain links and the male and female members are connected alternatively and successively to form a jewelry link assembly connected.

18. The method of claim 17, further comprising adjusting the length of the jewelry chain links by adding or removing the chain links and the male and female members alternatively and successively.

* * * * *